United States Patent [19]

Janeke

[11] Patent Number: 4,562,883

[45] Date of Patent: Jan. 7, 1986

[54] AIR CONDITIONING METHOD AND INSTALLATION

[76] Inventor: Charl E. Janeke, 261 Loveday St., Muckleneuk, Pretoria, Transvaal Province, South Africa

[21] Appl. No.: 611,376

[22] Filed: May 17, 1984

Related U.S. Application Data

[63] Continuation of Ser. No. 267,820, May 27, 1981, abandoned.

[51] Int. Cl.[4] ..... F24H 3/00

[52] U.S. Cl. ..... 165/1; 165/57; 165/59; 62/97

[58] Field of Search ..... 165/1, 2, 53, 57, 47, 165/59; 236/13; 237/46; 62/97; 98/31

[56] References Cited

U.S. PATENT DOCUMENTS

| | | | |
|---|---|---|---|
| 283,637 | 8/1883 | Mills | 237/46 X |
| 3,618,508 | 11/1971 | Tutt | 236/13 X |
| 3,744,556 | 7/1973 | Church | 165/96 X |
| 4,006,856 | 2/1977 | Nilsson | 98/31 |
| 4,013,217 | 3/1977 | Owen | 236/13 |
| 4,069,973 | 1/1978 | Edwards | 98/31 |
| 4,178,840 | 12/1979 | Caknis | 236/13 |
| 4,227,566 | 10/1980 | Stilber | 165/1 |
| 4,258,615 | 3/1981 | Vivian | 237/46 X |
| 4,281,592 | 8/1981 | Maxson et al. | 236/13 |

*Primary Examiner*—Henry Bennett

*Attorney, Agent, or Firm*—Sheridan Neimark; Karl W. Flocks; A. Fred Starobin

[57] ABSTRACT

Conditioned air (i.e. cooled or heated air) is supplied to spaces in a building structure via guides and air mains. The conditioned air is guided into the spaces directly from the guides, or via plenum chambers and transfer openings, or via both routes simultaneously. Circulation of conditioned air through the plenum chambers cools/-heats the building structure. During a subsequent period when cooled/heated air is demanded for the spaces, air from the spaces is circulated through the plenum chambers via air return openings. Such circulated air is cooled/heated by contact with the building structure and is re-introduced as conditioned air. The building structure thus acts as a reservoir of heat to augment the conditioning effort of the air conditioning means during periods of peak demand.

3 Claims, 7 Drawing Figures

AIR CONDITIONING METHOD AND INSTALLATION

This application is a continuation of application Ser. No. 267,820, filed May 27, 1981, now abandoned.

This invention relates to an air-conditioning method and installation.

In this specification the term 'conditioned air' or grammatical variations thereof, includes air which has been cooled or heated.

It is an object of this invention to provide a method of air conditioning which is more economical in the use of energy, than other systems known to the applicant.

In the conditioning of air for a space inside a building structure, in accordance with the invention, there is provided the method of using the building structure itself as a reservoir of heat, such that in use the reservoir will receive heat from the air when the air needs to be cooled, and will supply heat to the air when the air needs to be heated.

The exchange of heat between the air and the reservoir may take place cyclically and such that the supply of heat by the reservoir to the air takes place during one part of a cycle, and the reception of heat by the reservoir from the air takes place during another part of the cycle.

The invention extends to an air-conditioning installation for a building structure defining a space for which air is to be conditioned, the installation comprising a plenum chamber forming part of the building structure;

a partition separating the plenum chamber from a space to be supplied with conditioned air, air transfer and return openings being provided between the plenum chamber and the space to permit circulation of air through the plenum chamber and the space; and air-conditioning means adapted in use to supply conditioned air to the space directly or via the air transfer opening from the plenum chamber.

The air-conditioning means may include a guide defining an air flow passage for directing the conditioned air into the space, the guide being mounted in the partition and having a distribution chamber with an inlet connection for receiving conditioned air;

first and second outlets leading out of the distribution chamber; and a damper mechanism operable to direct flow of air out of either outlet or out of both outlets simultaneously; the first outlet in use being arranged to deliver conditioned air into the space directly, and the second outlet in use being arranged to deliver conditioned air to the space via the plenum chamber and the transfer opening.

The first outlet and the transfer opening may be disposed relative to each other in such a fashion that flow of air out of the first outlet will induce flow of air out of the plenum chamber through the transfer opening.

The invention extends yet further to a guide having means for mounting in the partition of the installation, and which includes a distribution chamber having an inlet for connection to a supply of conditioned air and having also first and second outlets leading out of the distribution chamber; and a damper mechanism operable to direct flow of air out of either outlet or out of both outlets simultaneously.

The invention is now described by way of example with reference to the accompanying diagrammatic drawings.

Figure 1:
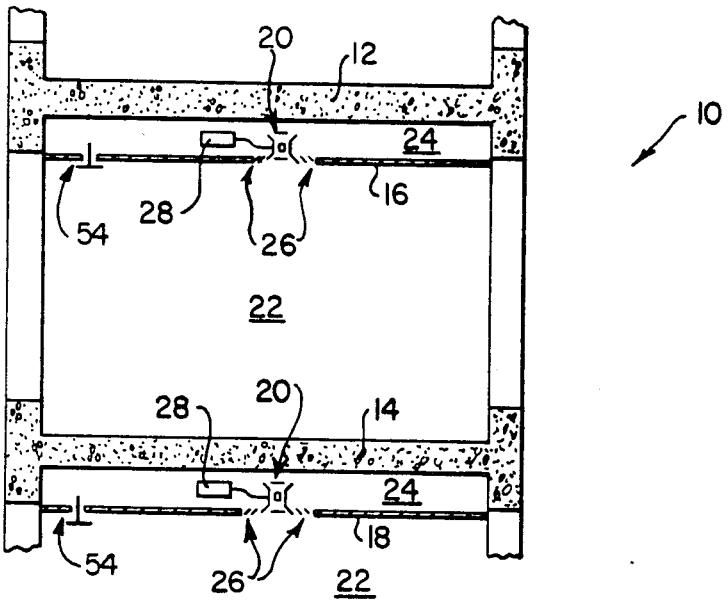
FIG. 1 shows, fragmentarily, a sectional elevation of a building structure in which the method of air-conditioning in accordance with the invention is being applied.

Referring to FIG. 1 of the drawings, reference numeral 10 generally indicates a building structure having slabs 12 and 14. Below the slabs 12 and 14, there are provided partitions in the form of ceilings 16 and 18, in which are mounted guides 20 in accordance with the invention, for directing conditioned air into the spaces 22 below the ceilings 16 and 18. Plenum chambers 24 are formed respectively between the slab 12 and the ceiling 16 and the slab 14 and the ceiling 18. Air transfer openings 26 and air return openings 54 are provided in the ceilings 16 and 18 to circulate air through the plenum chambers 24 and the spaces 22. Air ducts 28 extend along the plenum chambers 24 for supplying conditioned air from air-conditioning means (not shown) to the various spaces 22 of the building structure 10.

An air-conditioning installation in accordance with the invention for the building structure 10 comprises plenum chambers 24, partitions in the form of ceilings 16 and 18, separating the plenum chambers 24 from the spaces 22 to be supplied with conditioned air, transfer openings 26 and air-conditioning means (not shown). The operation of the air-conditioning installation will be described hereinafter.

Figure 2:
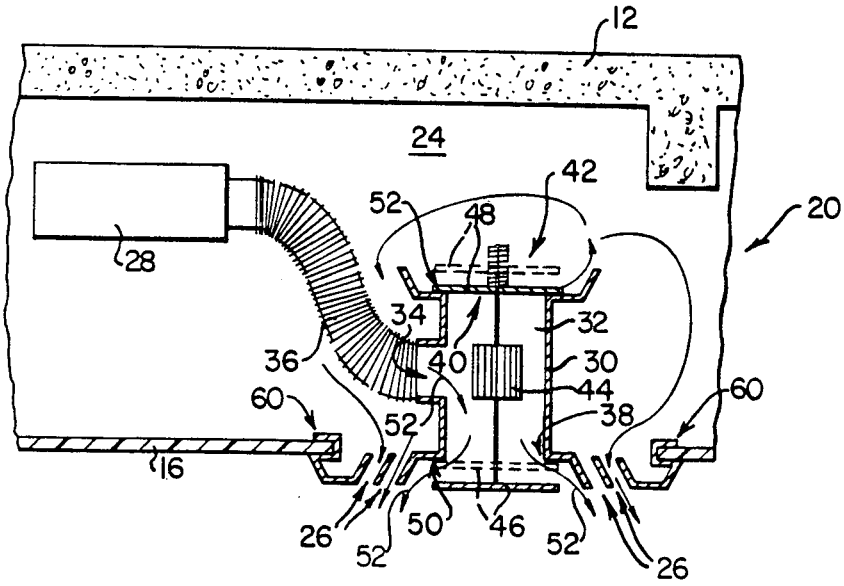
FIG. 2 shows, to a larger scale, a detailed axial section of a guide in accordance with the invention.

With reference now to FIG. 2 of the drawings, a guide 20 as shown in FIG. 1, is shown in detail in axial section. The guide 20 comprises a cylindrical casing 30 defining a distribution chamber 32 having an inlet 34 leading transversely into the casing 30 and being connected to an air main 28 via an air inlet duct 36. The distribution chamber 32 has a first outlet 38 and a second outlet 40 respectively at opposite ends of the casing 30 and leading axially out of the casing.

The guide 20 further has a damper mechanism 42 comprising an axially movable activator 44 connected to axially spaced, interconnected closure members 46 and 48. The closure members 46 and 48 can respectively be seated on and unseated from seats 50 and 52 provided in association with the outlets 38 and 40 at either end of the casing 30. As shown in solid lines, when the activator 44 is in its lowermost position, the closure member 46 is unseated from its seat 50, and the opening 38 interconnects distribution chamber 32 and the space 22 below the ceiling 16. The closure member 48 is seated on its seat 52 and prevents communication between the distribution chamber 32 and the plenum chamber 24 via the outlet 40. When the activator 44 is in its uppermost position, the closure member 46, as shown in dotted outline, is seated on its seat 50 to prevent direct communication between distribution chamber 32 and the space 22. The closure member 48 (as shown in dotted outlines) is unseated from its seat 52 and the distribution chamber 32 and the plenum chamber 24 are interconnected via the opening 40. The activator 44 may also be energised such as to be in an intermediate position when both closure members 46 and 48 will be unseated, and the distribution chamber will simultaneously be in communication with the space 22 and the plenum chamber 24. The relative degree to which the outlets 38 and 40 are open, is adjustable by energising the activator 44 to a suitable degree.

In practice, the activator 44 may be operable electrically or pneumatically. When it is electrically operable, it may be in the form of a solenoid with movable armature. When it is operable pneumatically, it may include a plunger and cylinder assembly. Whether the activator is energized electrically or pneumatically, such energising may take place from a position remote from the damper mechanism 32.

The guide 20 has mounting means 60 for mounting the guide 20 in the ceiling 16. The mounting means 60 extends laterally beyond the casing 30 and the transfer openings 26 are defined between the mounting means 60 and the casing 30.

In use, when cool air needs to be supplied to the space 22, the activator 44 is energized to be in its lowermost position. Cool air is received into the distribution chamber from air-conditioning means via the air main 28 and the inlet duct 36. The closure member 46 will be in its unseated condition, while the closure member 48 will be seated. Thus, cool air will pass directly from the distribution chamber 32 into the space 22 via the opening 38, as shown by arrows 52.

When most of the occupants have left and/or the ambient temperature drops, such as towards evening, the activator 44 is energised to move upwardly to its uppermost position, thus seating the closure member 46 and unseating the closure member 48. Thereupon, cool air will pass via the opening 40 into the plenum chamber 24. In the plenum chamber, the cool air comes into contact with the relatively hot building structure, such as the slab 12. The building structure is cooled down because heat energy is transferred from the relatively hot building structure to the relatively cool air in the plenum chamber. The heated air leaves the plenum chamber via the transfer openings 26 while fresh cool air enters the plenum chamber via the outlet 40. In this fashion, the building structure is progressively cooled down.

When there is a large demand for cool air, the closure members 46 and 48 will be arranged such that all the cool air received into the distribution chamber 32 will pass via the outlet 38 directly into the space 22 where the cool air is needed. The transfer openings 26 are arranged adjacent the outlet 38. Thus, flow of cool air through the opening 38 will induce a secondry stream of cool air to flow out of the plenum chamber 24 into the space 22 via the transfer openings 26 to augment the primary stream flowing through the outlet 38. Because the building structure enclosing the plenum chamber 24 has been cooled, the air flowing out of the plenum chamber 24 will also be cool air. Furthermore, return air flowing from the space 22 into the plenum chamber 24 via an opening 54 in the ceiling 16, to balance the outflow of air from the plenum chamber, will be cooled by coming into contact with the cooled-down building structure, before flowing into the space 22 via the transfer openings 26.

Accordingly the invention provides a method and air-conditioning installation by means of which, during periods of peak demand, an amount of cool air, in excess of the capacity of the air-conditioning means of the installation, can be supplied.

During periods when the demand for cool air is within the capacity of the air-conditioning means, the activator can be arranged to be in an intermediate position. Cool air will then be supplied to both the space 22 and the plenum chamber 24 simultaneously. The demand for cool air in the space 22 will be met, and the building structure will be cooled to prepare it for a subsequent period of peak demand.

In a similar manner, when the space 22 is to be heated, such as during a cold winter's day, the building structure is heated when heated air in the space 22 is not required or is required to a lesser degree. When the demand for heated air is high, the supply of heated air to the space 22 is augmented by hot air induced from the plenum chamber 24. Thus an amount of heated air, in excess of the capacity of the air conditioning means, can be supplied during peak demand periods.

Figure 3:
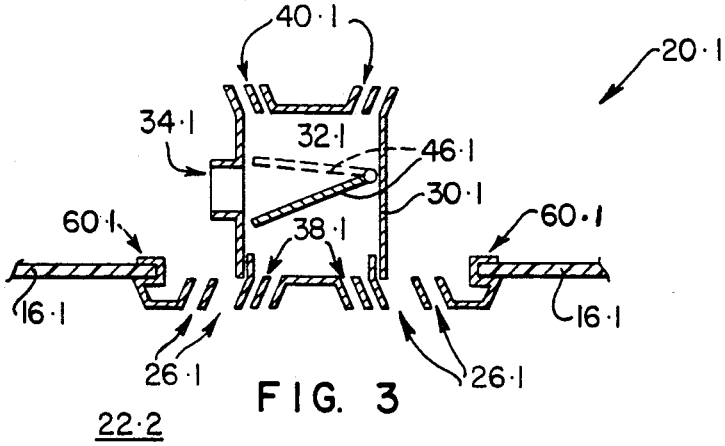
FIG. 3 shows an axial section of another embodiment of a guide in accordance with the invention.

Referring now to FIG. 3 of the drawings, a guide 20.1. similar to the guide 20 of FIG. 2, is shown. Like numerals refer to like parts. The guide 20.1 has a casing 30.1 which is of rectangular cross-section. A distribution chamber 32.1 is defined by the casing 30.1 and has an inlet 34.1 and first and second outlets 38.1 and 40.1. A closure member in the form of a gate 46.1 is pivotally mounted within the distribution chamber 32.1 and is operable to direct air mostly to the outlet 40.1 (when the closure member 46.1 is arranged as shown in solid lines), or mostly through the outlet 38.1 (when the closure member 46.1 is arranged to be in the position as shown in dotted lines). The gate 46.1 can also be arranged to be in an intermediate position in which amounts of air are directed through the outlets 38.1 and 40.1 simultaneously.

Figure 4:
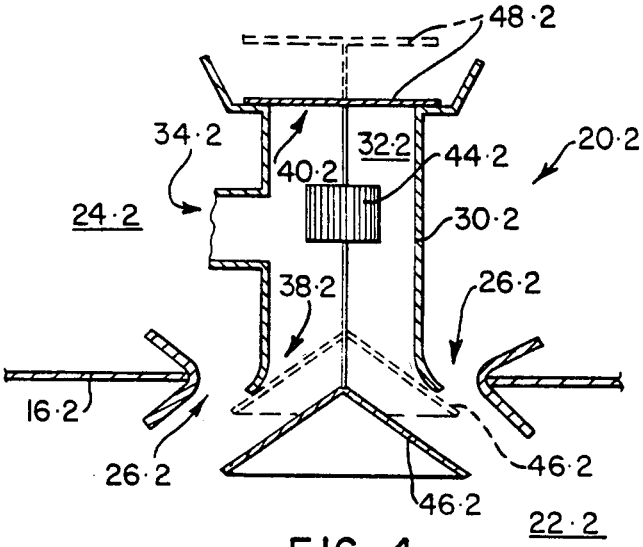
FIG. 4 shows an axial section of a further embodiment of a guide in accordance with the invention.

With reference to FIG. 4 of the drawings, a guide 20.2 is shown. The guide 20.2 is almost identical to the guide 20 of FIG. 2, with the exception that the lower closure member 26.2 is in the form of a cone or pyramid instead of being planar.

Figure 5:
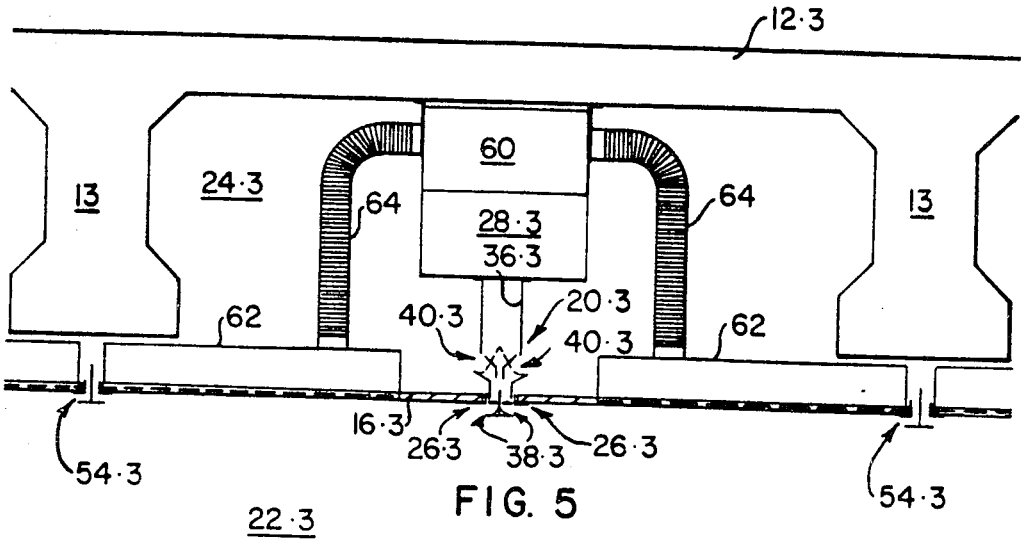
FIG. 5 shows, to a smaller scale, fragmentarily, a sectional elevation of another building structure in which another embodiment of a method in accordance with the invention is applied.

In FIG. 5, by way of development, another embodiment of an air-conditioning installation in accordance with the invention, is illustrated. The installation comprises a plenum chamber 24.3, a partition in the form of a ceiling 16.3 separating the plenum chamber 24.3 from a space 22.3 to be supplied with conditioned air, a transfer opening 26.3 and air-conditioning means (not shown). An air main 28.3 supplies conditioned air to the guide 20.3 via an inlet duct 36.3.

Figure 6:
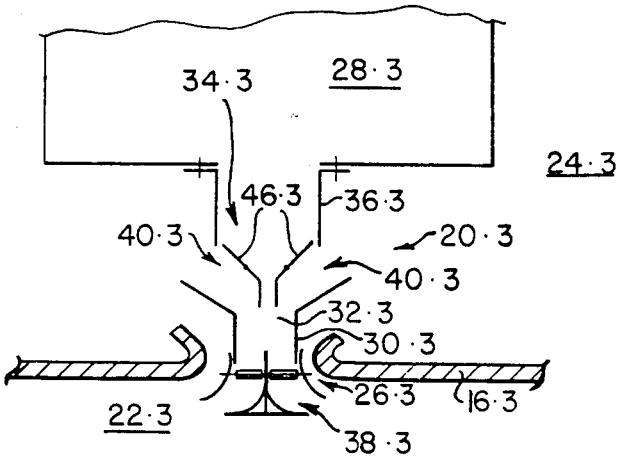
FIG. 6 shows, to a larger scale, an axial section of a guide in accordance with the invention as used in the method of FIG. 5.
Figure 7:
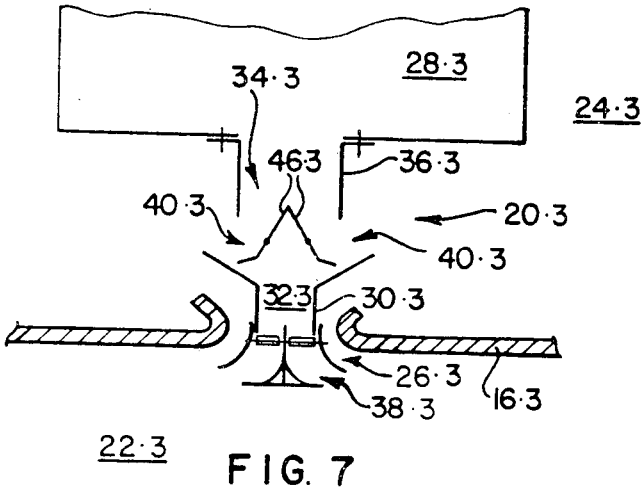
FIG. 7 shows the guide of FIG. 6, with its damper mechanism at another setting.

With reference also to FIGS. 6 and 7, the guide 20.3 has a casing 30.3 of rectangular section defining a distribution chamber 32.3. The distribution chamber 32.3 has an inlet 34.3, a first outlet 38.3 leading axially out of the distribution chamber 32.3 and second and third outlets 40.3 leading transversely out of the distribution chamber 32.3. A damper mechanism comprising closure members 46.3, is supplied. The closure members 46.3 are pivotally mounted upstream of the first outlet 38.3 and adjacent the second and third outlets 40.3. The closure members 46.3 act as gates in use, and can be arranged in positions as shown in FIG. 6 or 7; or in intermediate positions.

Substantially all of the conditioned air supplied to the guide 20.3 is directed into the space 22.3 directly via the outlet 38.3, when the closure members 46.3 are arranged as shown in FIG. 6.

When the closure members 46.3 are arranged as shown in FIG. 7, substantially all of the conditioned air is directed into the plenum chamber 24.3 and from there via the transfer openings 26.3 and the opening 54.3 into the space 22.3.

In the intermediate position of the closure members, air is directed into the space 22.3 directly and via the plenum chamber 24.3, simultaneously.

In addition to the slab 12.3, the building structure also comprises heavy beams 13 augmenting the heat capacity of the heat reservoir provided by the building structure.

The operation of the part of the air-conditioning installation described above, takes place in similar manner to that of the installation described with reference to FIGS. 1 and 2.

By way of development, the installation further comprises a return air main 60, and manifolds 62 arranged above lights (not shown) mounted in the ceiling 16.3 for lighting the space 22.3. Heat generated by the lights heats air contained in the manifolds 62, which air is withdrawn from the manifolds 62 via ducts 64 and the return air main 60. Such hot air is rejected to the atmosphere during periods when the demand is for cooled air such as during summer. When the demand is for hot air, such as during winter, the hot air is circulated through the plenum chamber 24.3 to heat the building structure. This arrangement further alleviates the demand on the air-conditioning means during periods when either cool or heated air is demanded.

An advantage of the invention is that, during periods of depressed temperatures, in between normally hot periods during which cooled air is demanded, the building structure is cooled at least partly due to the depressed ambient temperature. During a succeeding relatively hot period, air, cooled in the plenum chambers, can be introduced into the spaces requiring cool air, as herein described. Thus, cool air can be supplied in accordance with the invention, when the ambient temperature is relatively high, to a degree in excess of the actual cooling effort of the air-conditioning means. It is envisaged that the above advantage can be utilised when hot summer days are followed by relatively cool nights. This is an example of utilizing nondepletable energy.

In similar fashion, heated air can be supplied during relatively cold periods from heat stored in the building structure during relatively hot periods in between the cold periods. These conditions might, for example, occur when cold winters nights occur in between relatively warm winters days.

I claim:

1. A method of serving a building with cool air during daytime while using air-conditioning apparatus, the building having a space to be supplied with cool air, a plenum chamber above said space defined by the building structure, a partition between the space and the plenum chamber, and at least one air return opening through the partition intercommunicating the space and the plenum chamber, the method comprising the steps of, cyclically, during the night, venting the plenum chamber defined by the building structure, bringing cool air into said plenum chamber and cooling said building structure defining said plenum chamber, during a subsequent day introducing primary cool air, cooled by air-conditioning apparatus, by a primary air stream into said space, creating a secondary air flow from said space to said plenum chamber through said air return opening by evacuating the cooled air from said plenum chamber into said space, bringing the replacement air entering said plenum chamber into heat exchange relationship with precooled building structure defining said plenum chamber whereby the replacement air is cooled for inclusion in further air flow into said space.

2. The method of claim 1 further characterized by evacuating the cooled air from said plenum chamber into said space by using said primary air stream as an induction source.

3. The method of claim 1 further characterized by collecting heated air from the plenum chamber which emanates from lighting fixtures in the partition to prevent heat contamination of cool air in said plenum chamber by rejecting the heated air to the atmosphere.

* * * * *